US008689722B2

(12) United States Patent
Mccallum, Jr.

(10) Patent No.: US 8,689,722 B2
(45) Date of Patent: Apr. 8, 2014

(54) APPARATUS FOR HOLDING FISHING NETS OUTSIDE A BOAT

(76) Inventor: John William Mccallum, Jr., Mokena, IL (US)

( * ) Notice: Subject to any disclaimer, the term of this patent is extended or adjusted under 35 U.S.C. 154(b) by 154 days.

(21) Appl. No.: 13/472,466

(22) Filed: May 15, 2012

(65) Prior Publication Data

US 2012/0291690 A1 Nov. 22, 2012

Related U.S. Application Data

(60) Provisional application No. 61/457,700, filed on May 16, 2011.

(51) Int. Cl.
*B63B 17/00* (2006.01)

(52) U.S. Cl.
USPC ..... 114/343; 114/364; 43/8; 43/7

(58) Field of Classification Search
USPC ..... 114/343, 364; 43/7, 8
See application file for complete search history.

(56) References Cited

U.S. PATENT DOCUMENTS

| | | | | |
|---|---|---|---|---|
| 4,587,757 | A * | 5/1986 | Lirette | 43/21.2 |
| 2009/0188422 | A1 * | 7/2009 | Rupp, II | 114/364 |
| 2012/0291690 | A1 * | 11/2012 | Mccallum, Jr. | 114/343 |

* cited by examiner

*Primary Examiner* — Lars A Olson
*Assistant Examiner* — Jovon Hayes

(57) ABSTRACT

A net holster holds fishing nets outside a boat and out of the way of anglers inside the boat. The net holster of the present invention has over 100 adjustable positions to keep the net out of the way. The net holster can keep a net in place outside the boat of speeds of at least 30 miles per hour. The net holster of the present invention is designed to hold most nets. A universal clamp and a tie down clamp enable the net holster to fasten to a variety of marine vessels with very little effort.

10 Claims, 12 Drawing Sheets

APPARATUS FOR HOLDING FISHING NETS OUTSIDE A BOAT

CROSS-REFERENCE TO RELATED APPLICATIONS

This applications claims the benefit of priority of U.S. provisional patent application No. 61/457,700, filed May 16, 2011, the contents of which are herein incorporated by reference.

BACKGROUND OF THE INVENTION

The present invention relates to boating accessories and, more particularly, to an apparatus for holding a fishing net outside a boat and out of a fisherman's way.

Conventionally, a fishing net is carried by fishing boats for use by fishermen on board. The net is often set on the floor of the boat and can get in the way. Not only that, but a net may trip up fishermen as they move about the boat, creating a safety hazard. In addition, when the net is needed, the net may be under another fisherman's feet and may not be readily accessed.

As can be seen, there is a need for an improved apparatus for holding a fishing net outside of a boat, but to be readily available when needed.

SUMMARY OF THE INVENTION

In one aspect of the present invention, a net holster comprises a net lock for receiving a net handle; a support plate holding the net lock via a holster wireform; a swing plate pivotably attached to the support plate at a first end thereof; a barrel attached to the swing plate at a second end thereof, the barrel providing a rotatable connection to a hull clamp assembly; and a hull cleat assembly adapted to receive the hull clamp assembly and permit the hull clamp assembly to rotate thereabout.

In another aspect of the present invention, a net holster comprises a net lock for receiving a net handle; a support plate holding the net lock via a holster wireform, wherein the holster wireform includes two wires attached to the support plate with a locking clip, the locking clip permitting adjustment of a position of the net lock relative to the support plate; a swing plate pivotably attached to the support plate at a first end thereof; a locking pin spring plate resiliently holding a locking pin through a hole in the swing plate and into one of a plurality of holes in the support plate, permitting the support plate to be pivoted relative to the swing plate; a barrel attached to the swing plate at a second end thereof, the barrel providing a rotatable connection to a hull clamp assembly; and a hull cleat assembly adapted to receive the hull clamp assembly and permit the hull clamp assembly to rotate thereabout, wherein the hull clamp assembly includes a cleat rotator lock adapted to resiliently engage with the hull cleat assembly to prevent rotation of the hull clamp assembly unless the cleat rotator lock is disengaged.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a net holster that holds fishing nets outside a boat and out of the way of anglers inside the boat. The net holster of the present invention has over 100 adjustable positions to keep the net out of the way. The net holster can keep a net in place outside the boat of speeds of at least 30 miles per hour. The net holster of the present invention is designed to hold most nets. A universal clamp and a tie down clamp enable the net holster to fasten to a variety of marine vessels with very little effort.

Figure 1:
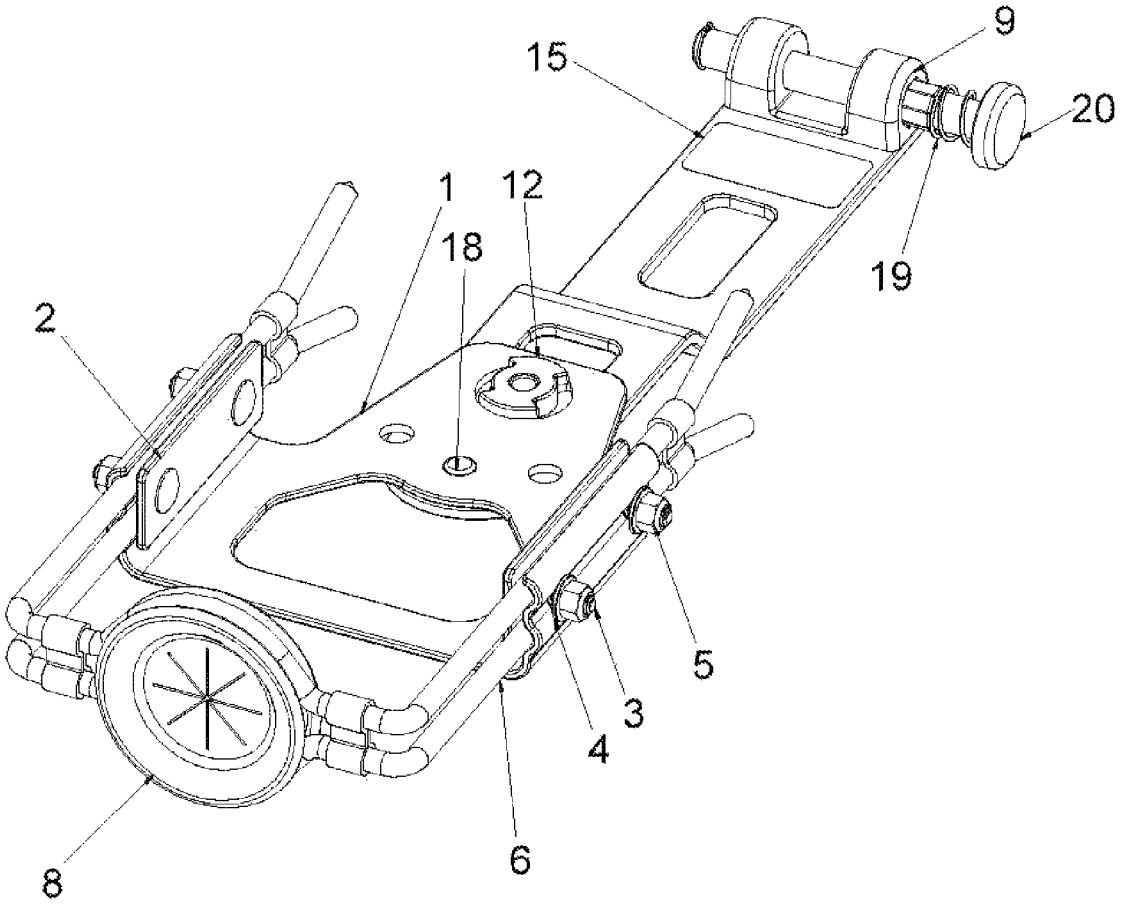
FIG. 1 is a top view of a swing plate assembly used in the net holder of the present invention.
Figure 2:
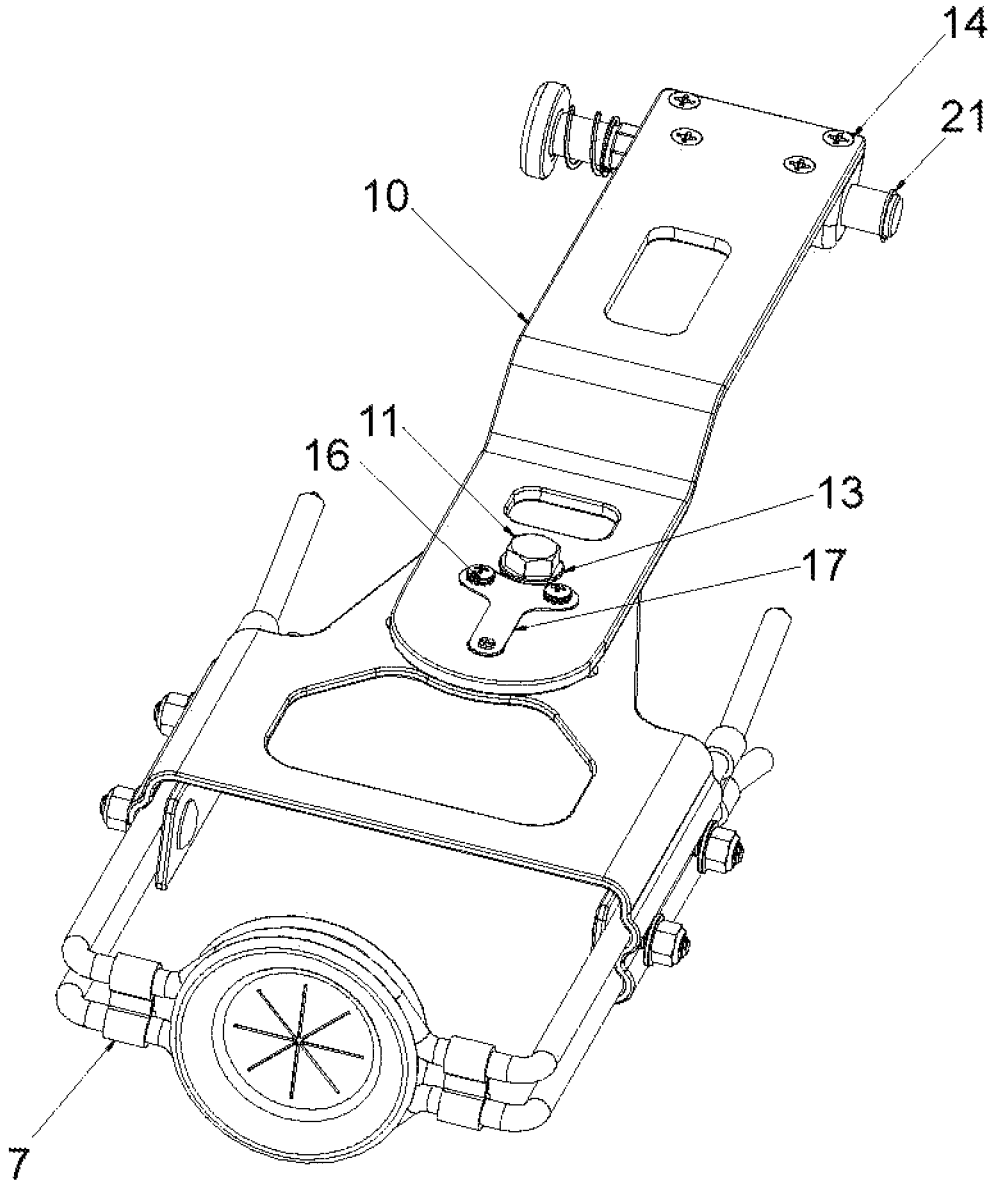
FIG. 2 is a bottom view of the swing plate assembly of FIG. 1.
Figure 3:
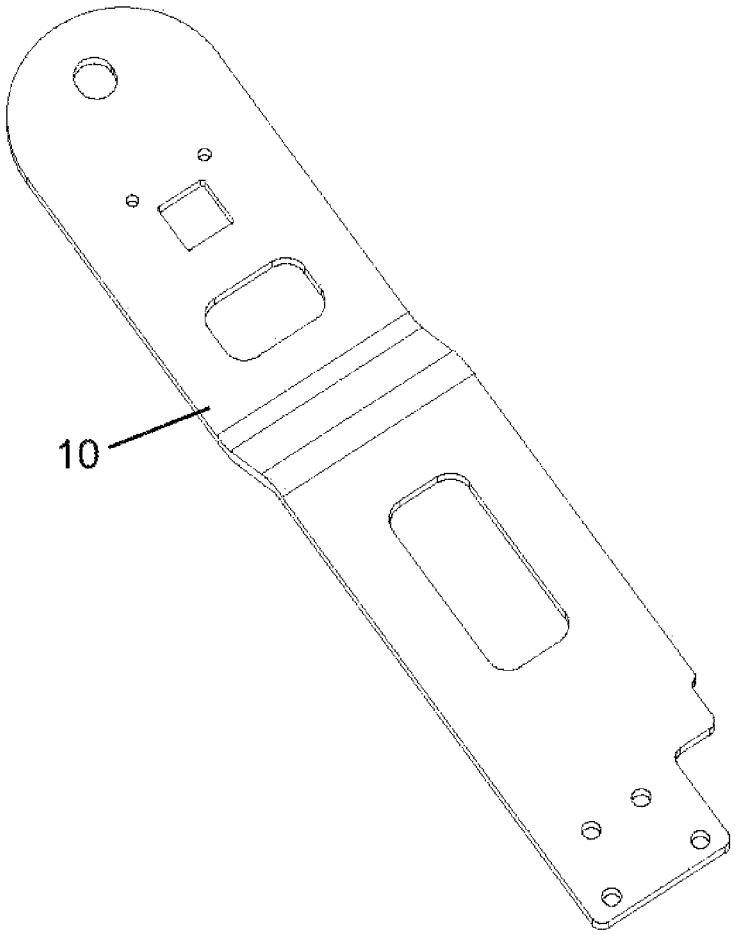
FIG. 3 is a perspective view of a swing plate of the swing plate assembly of FIG. 1.
Figure 4:
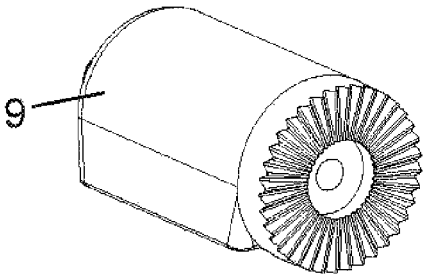
FIG. 4 is a top perspective view of a barrel of the swing plate assembly of FIG. 1.
Figure 5:
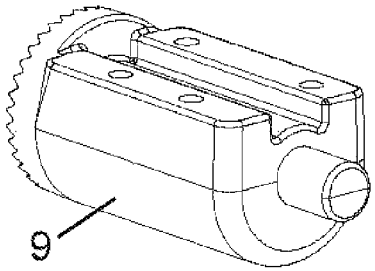
FIG. 5 is a bottom perspective view of the barrel of FIG. 4.
Figure 6:
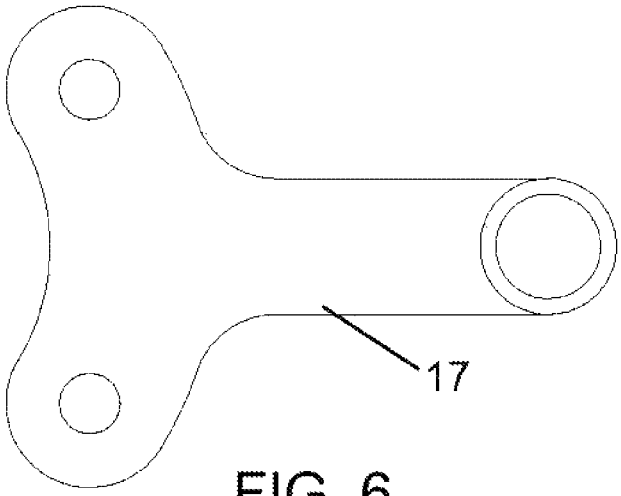
FIG. 6 is a top view of a locking pin assembly of the swing plate assembly of FIG. 1.
Figure 7:
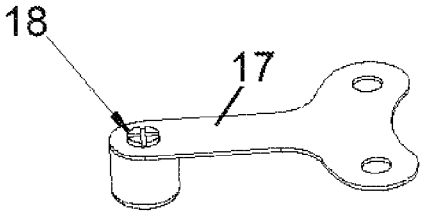
FIG. 7 is a perspective view of the locking pin assembly of FIG. 6.
Figure 8:
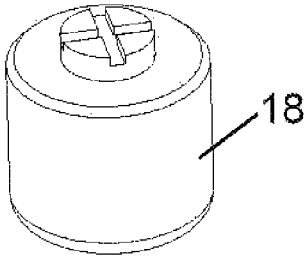
FIG. 8 is a perspective view of a locking pin of the locking pin assembly of FIG. 6.
Figure 9:
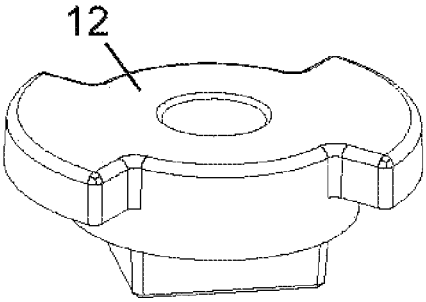
FIG. 9 is a top perspective view of a holster lock of the swing plate assembly of FIG. 1.
Figure 10:
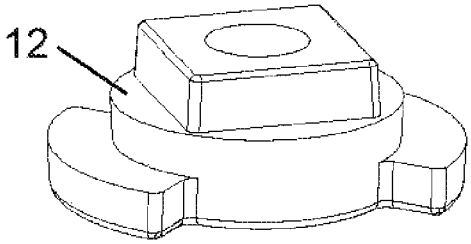
FIG. 10 is a bottom perspective view of the holster lock of FIG. 9.
Figure 11:
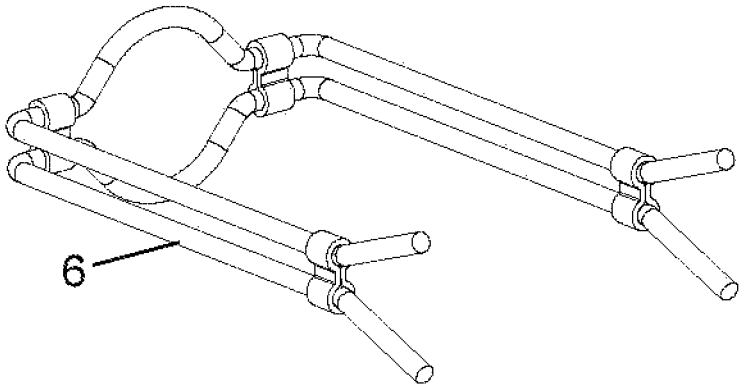
FIG. 11 is a perspective view of a wireform assembly of the swing plate assembly of FIG. 1.
Figure 12:
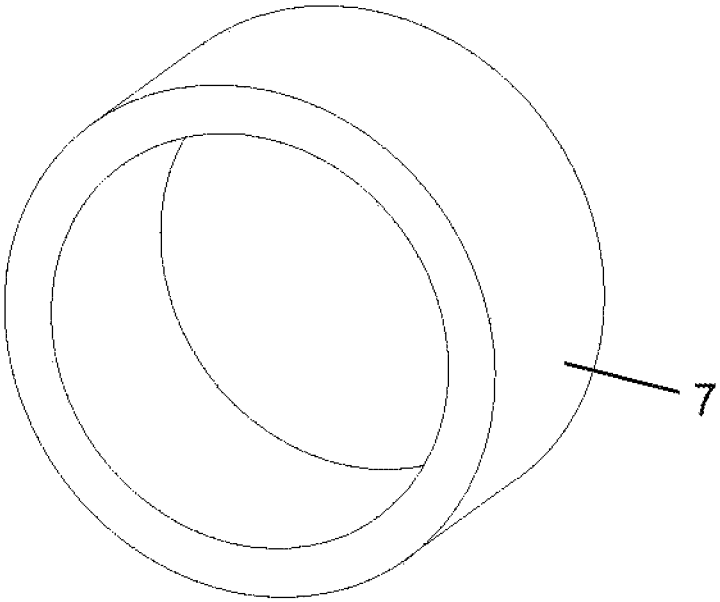
FIG. 12 is a perspective view of a wire crimp of the wireform assembly of FIG. 11.
Figure 13:
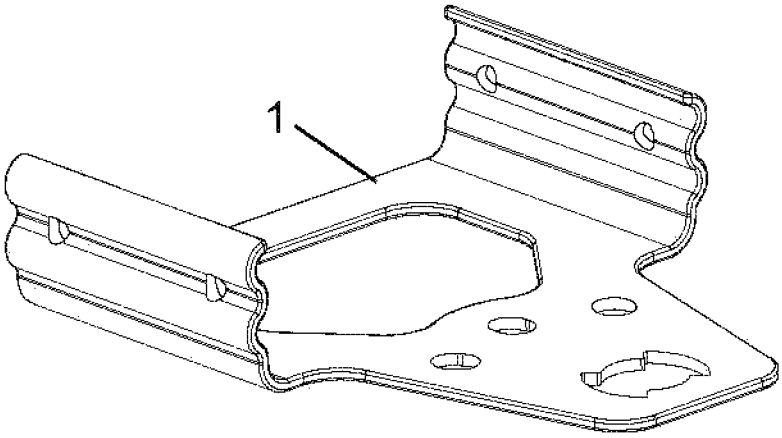
FIG. 13 is a perspective view of a support plate of the swing plate assembly of FIG. 1.
Figure 14:
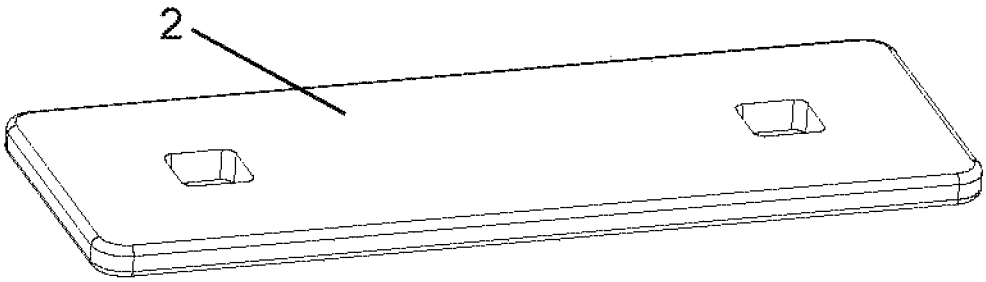
FIG. 14 is a perspective view of a locking clip of the swing plate assembly of FIG. 1.

Referring now to FIGS. 1 through 14, a net lock 8 may be adapted to hold a net handle therewithin and may be made of rubber, for example, form fitted for a holster wireform 6 held together by a wire crimp 7. The holster wireform 6 is fastened to a support plate 1 by a locking clip 2, a fastener, such as a bolt 3, a washer 4 and a nut, such as a locking nut 5. The support plate 1 may be fastened to a swing plate 10 by a screw 11 and a holster lock 12. The swing plate 10 may be fastened to a rosette barrel 9 by a screw 14.

Figure 15:
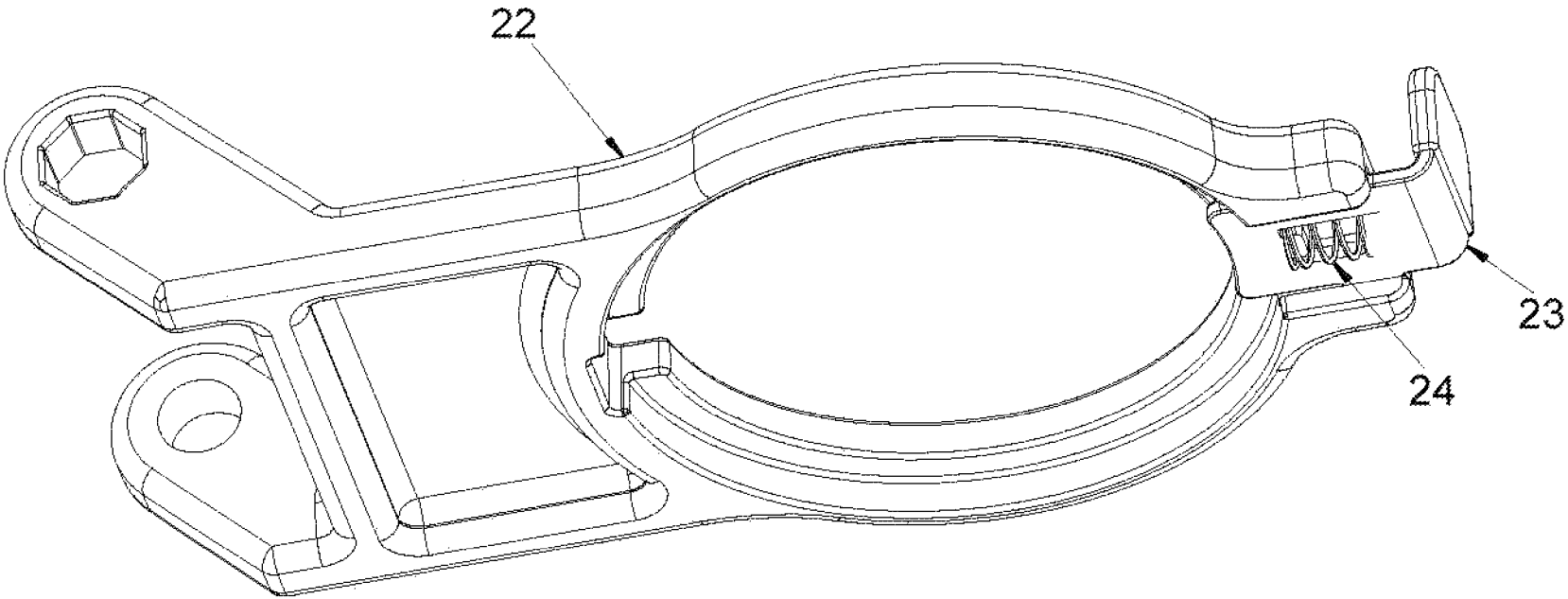
FIG. 15 is a perspective view of a hull clamp assembly for receiving the swing plate assembly of FIG. 1.
Figure 16:
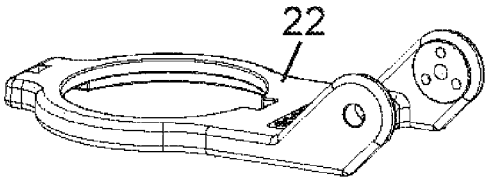
FIG. 16 is a bottom perspective view of a top plate of the hull clamp assembly of FIG. 15.
Figure 17:
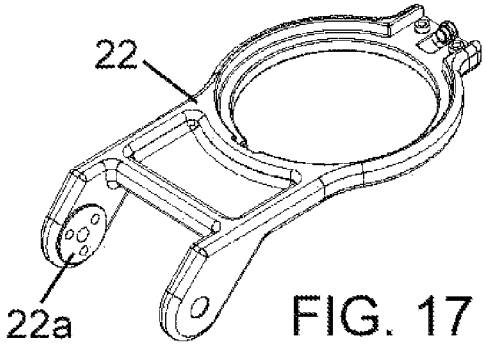
FIG. 17 is a top perspective view of the top plate of FIG. 16.
Figure 18:
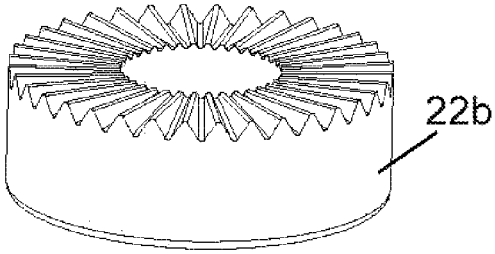
FIG. 18 is a perspective view of a rosette of the hull clamp assembly of FIG. 15.
Figure 19:
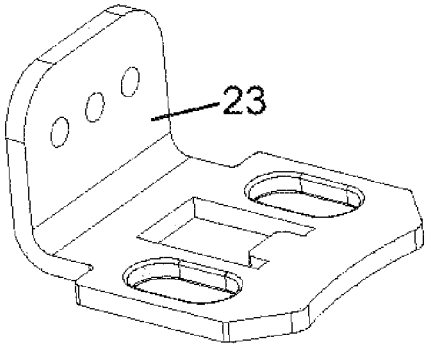
FIG. 19 is a perspective view of a cleat rotator lock of the hull clamp assembly of FIG. 15.
Figure 20:
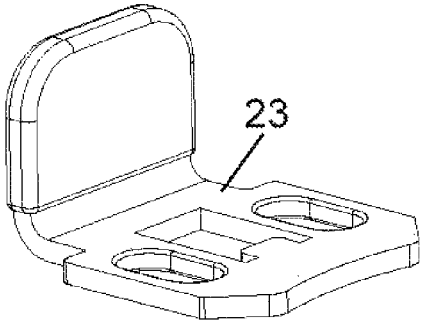
FIG. 20 is a perspective view of the cleat rotator lock of FIG. 19 after being coated with a plastic coating.
Figure 21:
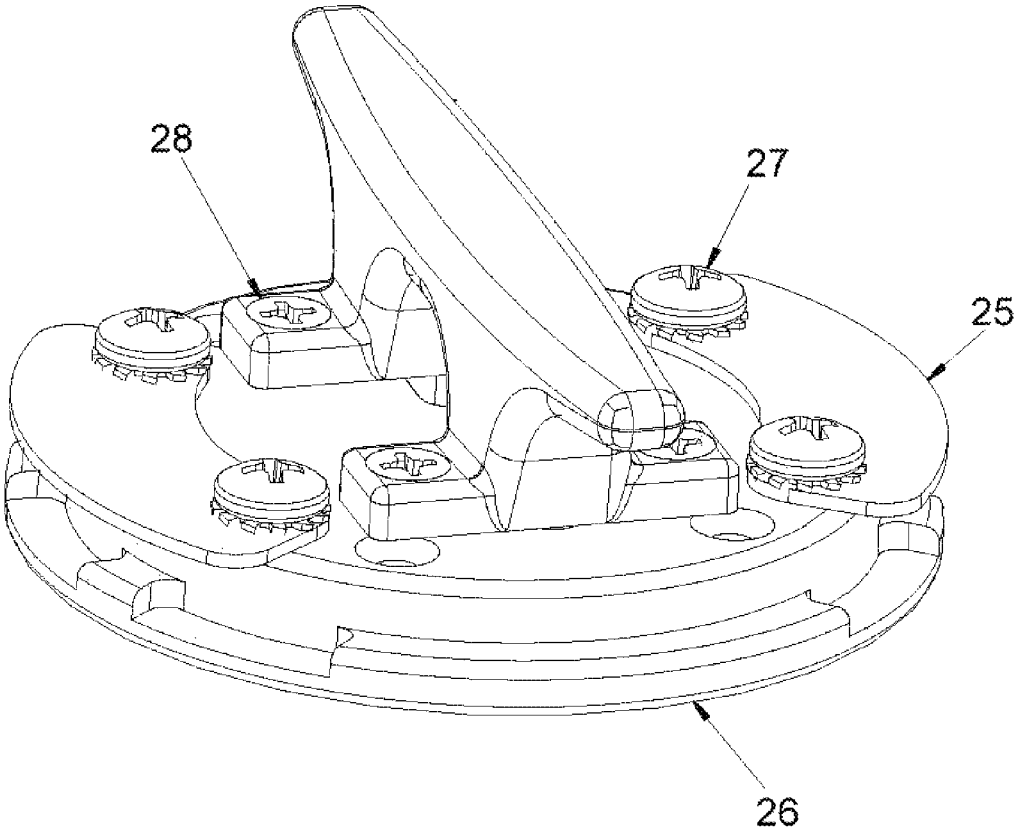
FIG. 21 is a perspective view of a hull cleat assembly for receiving the hull clamp assembly of FIG. 15.
Figure 22:
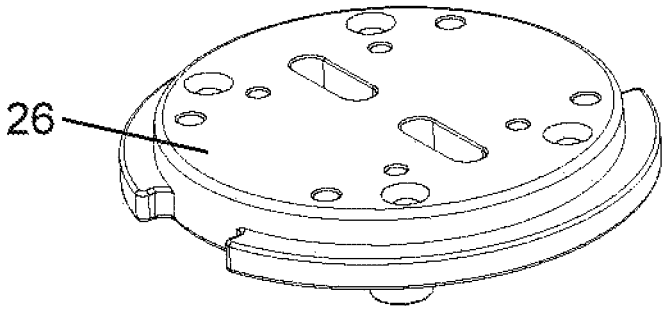
FIG. 22 is a top perspective view of a cleat rotator of the hull cleat assembly of FIG. 21.
Figure 23:
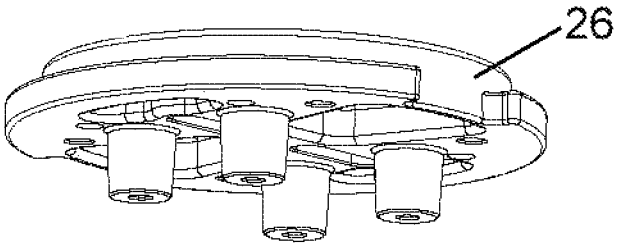
FIG. 23 is a bottom perspective view of the cleat rotator of FIG. 22.
Figure 24:
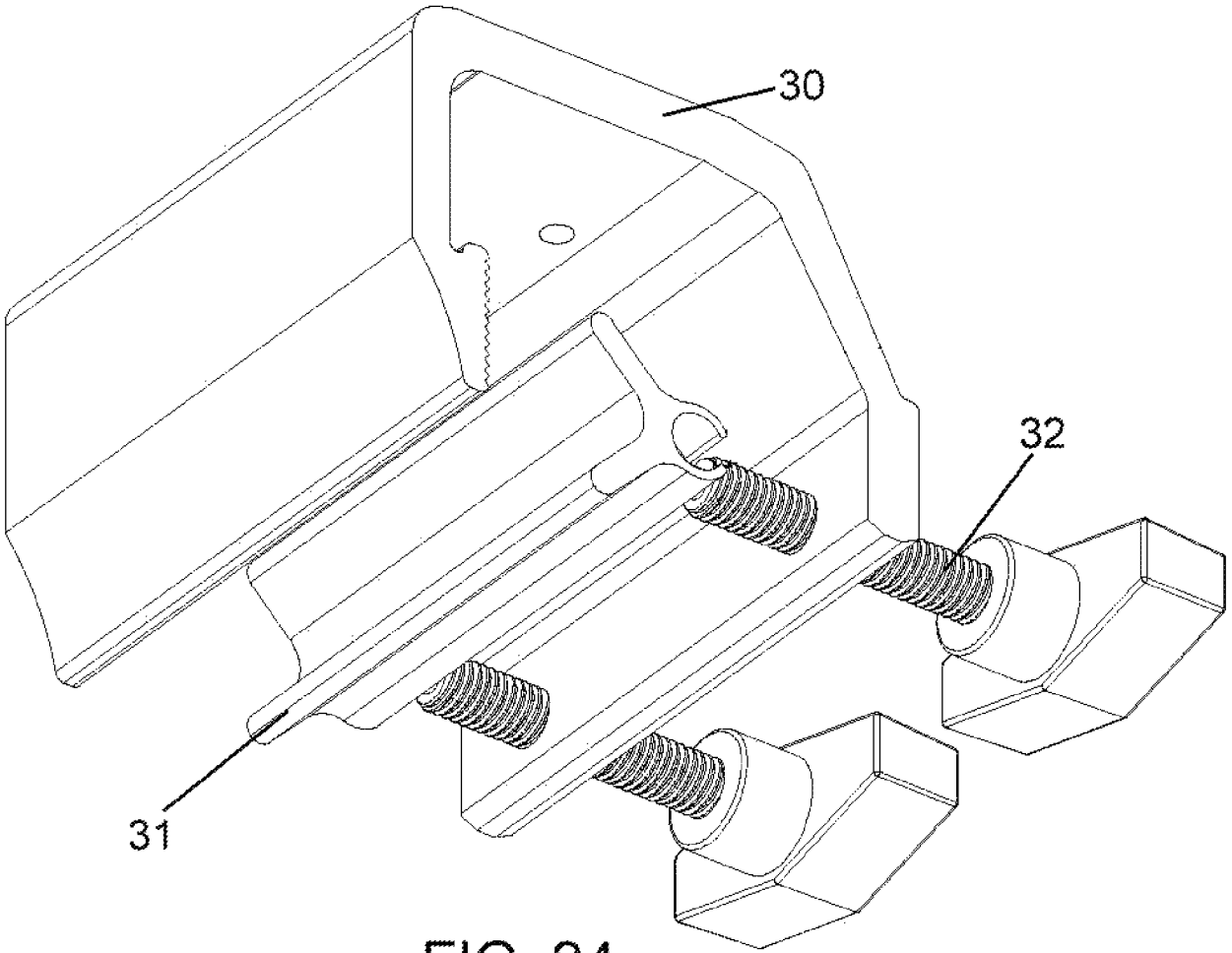
FIG. 24 is a perspective view of a rail clamp assembly for receiving the hull cleat assembly of FIG. 21, according to one embodiment of the present invention.
Figure 25:
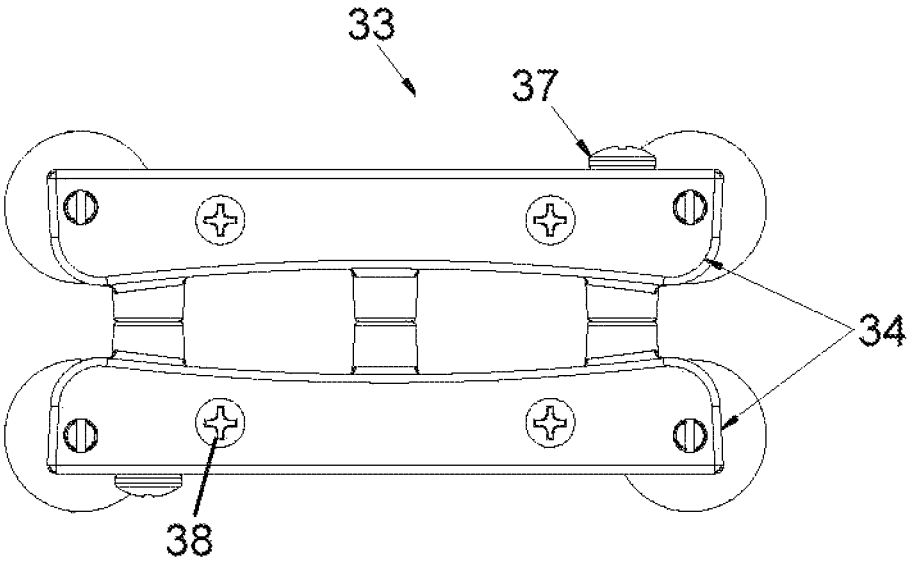
FIG. 25 is a top view of a tie down clamp assembly for receiving the hull cleat assembly of FIG. 21, according to another embodiment of the present invention.
Figure 26:
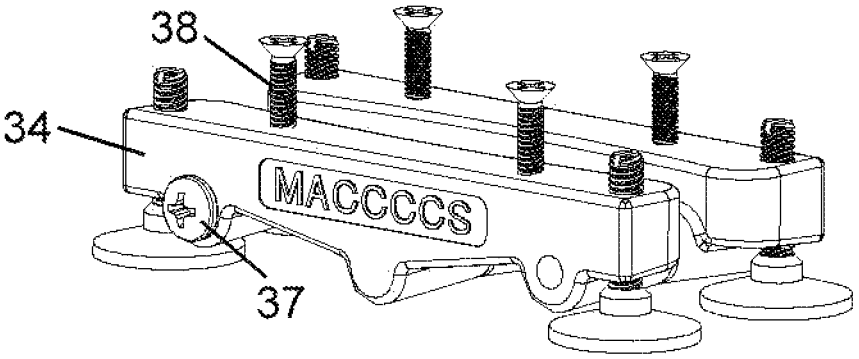
FIG. 26 is a perspective view of the tie down clamp assembly of FIG. 25.

Referring additionally to FIGS. 14 through 26, the rosette barrel 9 may be fastened to a top plate 22 by a rosette swing plate lock 20. The top plate 22 may be fastened to a cleat rotator 26 by a cleat lock 25 and screws 27. The cleat rotator 26 may be attached to a boat gunnel via a rail clamp assembly 29 or to a tie down clamp assembly 33, which may be secured to a tie down on a boat.

The cleat rotator 26 can be mounted to the boat gunnel or clean clamp (tie down clamp assembly 33), which allows the top plate 22 to be attached to the cleat rotator 26 by the cleat lock 25 and screws 27 and enables the net holster to rotate 360 degrees. The swing plate 10 can be attached to the top plate 22 by the rosette barrel 9 and the rosette swing plate lock 20. The rosette barrel 9 may interlock with a rosette 22*b* that may be attached to a rosette attachment 22*a* on the top plate 22. This rosette system allows the net holster to swing up and down and the rosette system allows it to be locked in place at various angles.

The support plate 1 can be mounted to the swing plate 10 by screws 11, the holster lock 12 and washer 13. The support plate 1 has a plurality of different positions, such as three positions that it can be adjusted to by pushing a locking pin 18. The holster wireform 6 can be held together by wire crimps 7, which then allows the net lock 8 to snap therein. The net lock 8 provides friction to help hold the net (not shown) in place. The holster wireform 6 may move up and down so that it can be locked in at several different heights. The holster wireform 6 may be made of two wires with their ends fanned apart to secure a net end of a fishing net.

The net holster of the present invention can hang outside the boat, but with all the different adjustments, 360 degrees in circle or up and down, it can even hang inside the boat. This gives the user many different options to get the net out of the way.

As discussed above, the cleat rotator 26 may be attached to the rail clamp assembly 29. The rail clamp assembly 29 includes a U-shaped fixed clamping member 30 and an adjustable clamping member 31. The adjustable clamping member 31 may move away from one side of the fixed clamping member 30 by tightening one or more clamp screws 32 which are threaded into one side of the fixed clamping member 30.

In some embodiments, the cleat rotator 26 may be attached to a tie down clamp assembly 33. The tie down clamp assembly 33 may be made two side members 34 that may have protrusions 35 extending outward from one side thereof. The protrusions 35 of each side member 34 may meet. The protrusions 35 may engage with a tie down cleat on a boat. The side members 34 may connect together with screws 37. Tightening the screws 26 can engage the tie down clamp assembly 33 to a tie down cleat. The tie down clamp assembly 33 may have mounting screws 38 on a top surface to attach the cleat rotator 26. Adjustable feet 36 may adjust the height of the tie down clamp assembly 33.

The net holster may be made from various materials, typically materials adapted for use in wet, marine environments, such as aluminum, galvanized steel, stainless steel and the like. The parts can be stamped or die-cast and then assembled with screws, pins, nuts, washers, bolts and the like.

While the above description uses a rosette system for providing up/down adjustments, other locking systems may be used to provide the adjustments as discussed above.

It should be understood, of course, that the foregoing relates to exemplary embodiments of the invention and that modifications may be made without departing from the spirit and scope of the invention as set forth in the following claims.

What is claimed is:

1. A net holster comprising:

a net lock for receiving a net handle;

a support plate holding the net lock via a holster wireform;

a swing plate pivotably attached to the support plate at a first end thereof;

a barrel attached to the swing plate at a second end thereof, the barrel providing a rotatable connection to a hull clamp assembly; and a hull cleat assembly adapted to receive the hull clamp assembly and permit the hull clamp assembly to rotate thereabout.

2. The net holster of claim 1, wherein the holster wireform includes two wires attached to the support plate with a locking clip, the locking clip permitting adjustment of a position of the net lock relative to the support plate.

3. The net holster of claim 2, further comprising a wire crimp adapted to hold the two wires of the holster wireform together.

4. The net holster of claim 1, further comprising a locking pin spring plate resiliently holding a locking pin through a hole in the swing plate and into one of a plurality of holes in the support plate, permitting the support plate to be pivoted relative to the swing plate.

5. The net holster of claim 1, wherein the barrel rotatably engages with the hull clamp assembly via a rosette system.

6. The net holster of claim 1, wherein the hull clamp assembly includes a cleat rotator lock adapted to resiliently engage with the hull cleat assembly to prevent rotation of the hull clamp assembly unless the cleat rotator lock is disengaged.

7. The net holster of claim 1, further comprising a rail clamp assembly adapted to retain the hull clamp assembly to a rail of a boat.

8. The net holster of claim 1, further comprising a tie down clamp assembly adapted to secure to a tie down cleat of a boat and retain the hull clamp assembly.

9. A net holster comprising:

a net lock for receiving a net handle;

a support plate holding the net lock via a holster wireform, wherein the holster wireform includes two wires attached to the support plate with a locking clip, the locking clip permitting adjustment of a position of the net lock relative to the support plate;

a swing plate pivotably attached to the support plate at a first end thereof;

a locking pin spring plate resiliently holding a locking pin through a hole in the swing plate and into one of a plurality of holes in the support plate, permitting the support plate to be pivoted relative to the swing plate;

a barrel attached to the swing plate at a second end thereof, the barrel providing a rotatable connection to a hull clamp assembly; and a hull cleat assembly adapted to receive the hull clamp assembly and permit the hull clamp assembly to rotate thereabout, wherein the hull clamp assembly includes a cleat rotator lock adapted to resiliently engage with the hull cleat assembly to prevent rotation of the hull clamp assembly unless the cleat rotator lock is disengaged.

10. The net holster of claim 9, wherein the barrel rotatably engages with the hull clamp assembly via a rosette system.

* * * * *